US008544550B2

(12) United States Patent
Willoughby

(10) Patent No.: US 8,544,550 B2
(45) Date of Patent: Oct. 1, 2013

(54) SUBSEA WELLHEAD WITH SEGMENTED FATIGUE REDUCTION SLEEVE

(75) Inventor: Daniel A Willoughby, Uig (GB)

(73) Assignee: Aker Subsea Limited, Maidenhead, Berkshire (GB)

( * ) Notice: Subject to any disclaimer, the term of this patent is extended or adjusted under 35 U.S.C. 154(b) by 120 days.

(21) Appl. No.: 13/086,551

(22) Filed: Apr. 14, 2011

(65) Prior Publication Data

US 2011/0253381 A1 Oct. 20, 2011

(30) Foreign Application Priority Data

Apr. 14, 2010 (GB) ..... 1006158.8
May 13, 2010 (GB) ..... 1007974.7

(51) Int. Cl.
*E21B 7/12* (2006.01)

(52) U.S. Cl.
USPC ..... 166/360; 166/368; 166/384; 166/382

(58) Field of Classification Search
USPC ..... 166/368, 242.6, 346, 338, 360, 382, 166/384; 285/235–237, 294.1; 405/157, 405/168.1, 168.2, 169, 224.2, 224.3
See application file for complete search history.

(56) References Cited

U.S. PATENT DOCUMENTS 1,345,543 A * 7/1920 Huth ..... 285/288.2
2,249,170 A * 7/1941 Quintrell ..... 166/138
2,806,535 A * 9/1957 Bender et al. ..... 166/115
3,402,946 A * 9/1968 Dedian ..... 285/236
3,405,763 A * 10/1968 Pitts et al. ..... 166/382
3,952,799 A * 4/1976 Simpson ..... 166/116
4,110,991 A * 9/1978 Torkuhl ..... 405/157
4,116,044 A * 9/1978 Garrett ..... 73/40.5 R
4,326,584 A * 4/1982 Watkins ..... 166/84.2
4,383,554 A * 5/1983 Merriman ..... 138/101
4,499,950 A 2/1985 Watkins
4,629,363 A * 12/1986 Rose et al. ..... 405/155
4,712,776 A * 12/1987 Geno et al. ..... 267/64.21
4,772,178 A * 9/1988 Miller ..... 415/177
4,807,705 A * 2/1989 Henderson et al. ..... 166/348
4,823,880 A * 4/1989 Klatt ..... 166/373
4,854,781 A * 8/1989 Sparks et al. ..... 405/224.4

(Continued)

FOREIGN PATENT DOCUMENTS

WO WO 2009/093911 7/2009

OTHER PUBLICATIONS

Notification of Transmittal of the International Search Report and the Written Opinion of the International Searching Authority, or the Declaration mailed Oct. 8, 2012, in International Application No. PCT/GB2011/000403.

(Continued)

*Primary Examiner* — Matthew Buck
*Assistant Examiner* — Aaron Lembo
(74) *Attorney, Agent, or Firm* — Nixon & Vanderhye PC

(57) ABSTRACT

A subsea wellhead a generally cylindrical body including a lower extension for forming an annular space for a cement column between the lower extension and an outer conductor. The extension carries a multiplicity of interfitting rings forming a sleeve which facilitates flexure of the extension in the presence of the cement column. Each ring may comprise an inner flange for disposition adjacent the outside of the extension and an outer flange for fitment over the inner flange of an adjacent ring. The outer flange may have a radial throughbore.

7 Claims, 1 Drawing Sheet

(56) References Cited

U.S. PATENT DOCUMENTS

| | | | | |
|---|---|---|---|---|
| 5,029,647 | A | 7/1991 | Milberger et al. | |
| 5,215,338 | A * | 6/1993 | Kimura et al. | 285/154.2 |
| 5,299,643 | A | 4/1994 | Vetter et al. | |
| 5,971,076 | A * | 10/1999 | Taylor et al. | 166/368 |
| 7,150,324 | B2 * | 12/2006 | Laursen et al. | 166/355 |
| 7,331,604 | B2 * | 2/2008 | Lang et al. | 280/736 |
| 2002/0023751 | A1 * | 2/2002 | Neuroth et al. | 166/302 |
| 2003/0037927 | A1 * | 2/2003 | Dalrymple et al. | 166/302 |
| 2006/0162937 | A1 * | 7/2006 | Costa et al. | 166/380 |
| 2009/0101328 | A1 * | 4/2009 | Leslie et al. | 166/65.1 |

OTHER PUBLICATIONS

Written Opinion of the International Searching Authority mailed Oct. 8, 2012, in International Application No. PCT/GB2011/000403.

* cited by examiner

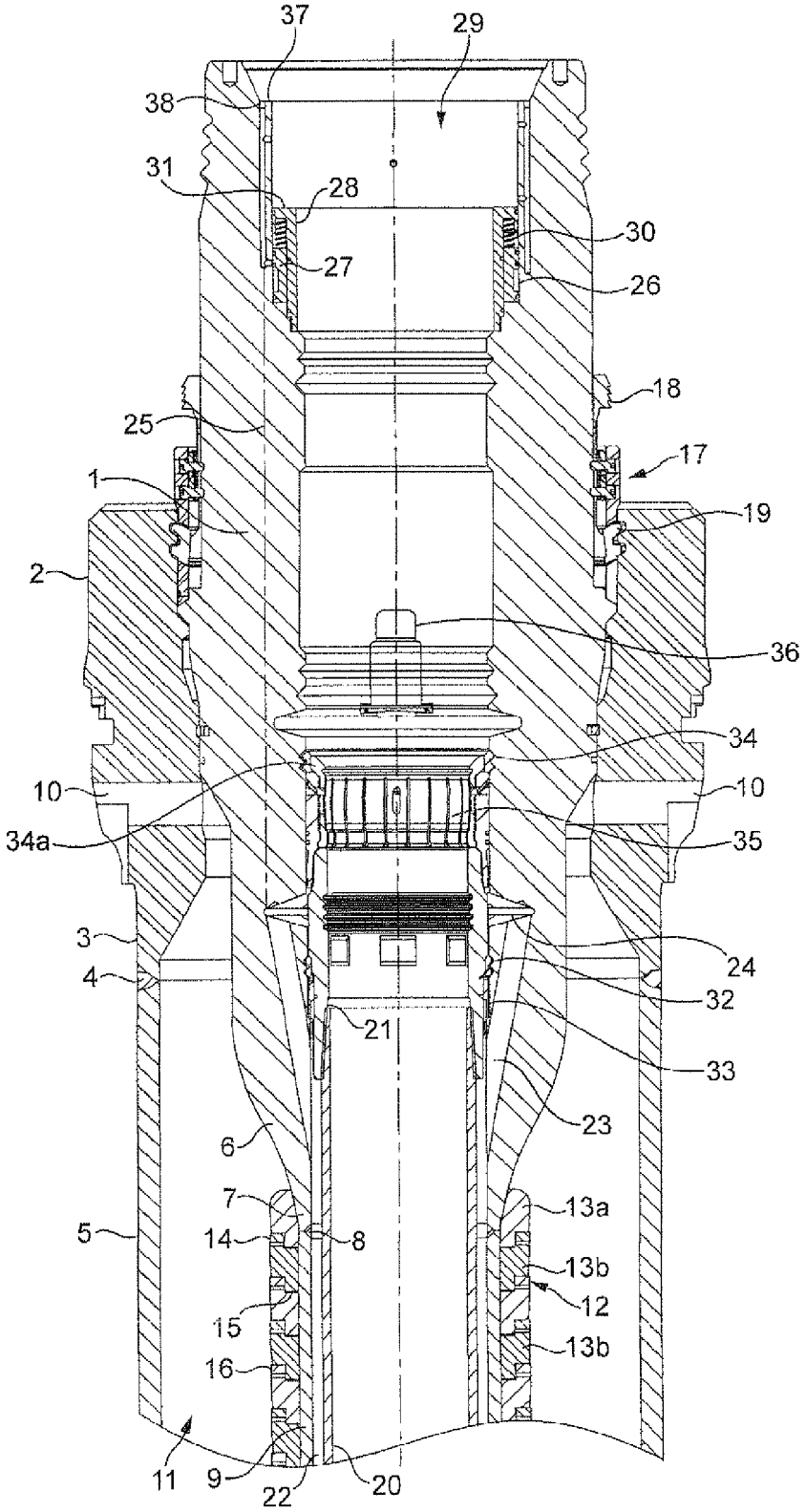
37
29
38
31
28
30
27
26
18
25
17
1
19
2
36
34
10
10
34a
35
3
24
4
32
21
33
23
6
7
13a
5
14
8
13b
12
15
13b
16
11
9
22
20

SUBSEA WELLHEAD WITH SEGMENTED FATIGUE REDUCTION SLEEVE

This application claims priority from GB patent applications No. 1006158,8 filed Apr. 14, 2010 and No. 1007974.7 filed May 13, 2010, the entire contents of which applications are hereby incorporated by reference.

TECHNICAL FIELD

This invention relates to subsea wellheads.

BACKGROUND

Currently all wellhead systems comprise a rigid extension, normally of steel, welded onto a shaped lower part of the wellhead body. Such an extension is exposed to an injected column of cement in an annular space between the extension, and any casing string that it supports, and an outer conductor housing and any casing string that it supports.

Wellhead systems are exposed to cyclic forces from, usually, the drilling rig, the marine riser, motion of the blow-out preventer (BOP) and from other causes of pressures in the well bore. Repeated forces will, if sufficiently large or extended over sufficient time, produce a liability to fatigue damage and the possible failure of the wellhead system. The aforementioned column in the annular space is important to ensure control of the well. However, there is no established means of controlling the final height of the cement and there is a presumption that the cement will extend up to the level of the circulation ports. Cement at this high level on the outside of the wellhead extension reduces the freedom of the extension to flex. This loss of freedom is liable to produce repetitive stress which is potentially great enough to cause fatigue failure.

RELATED ART

It is known from U.S. Pat. No. 5,029,847 to provide the exterior of the extension with a continuous elastomeric sleeve which is about 3 to 6 mm thick and prevents bonding of the cement to the extension. However, such a thin unitary sleeve is easily damaged and has a predetermined longitudinal extent.

SUMMARY

The exemplary embodiment provides a subsea wellhead comprising a generally cylindrical body including a lower extension for forming an annular space for a cement column between the lower extension and an outer conductor, in which the extension carries a multiplicity of interfitting rings forming a sleeve which facilitates the flexure of the extension in the presence of the cement column.

Each ring may comprise an inner flange for disposition adjacent the outside of the extension and an outer flange for fitment over the inner flange of an adjacent ring. The outer flange may have a radial through-bore.

One example of the present invention will be described in detail with reference to the accompanying drawing.

BRIEF DESCRIPTION OF THE DRAWING

The single FIG. 1 is a sectional view of a wellhead according to an exemplary embodiment of the invention.

DETAILED DESCRIPTION

FIG. 1 illustrates in section a subsea wellhead assembly. The particular assembly illustrated is designed for use with a riser system of 13 ⅝" (346 mm) inside diameter within either a standard 30" (762 mm) or 36" (914.4 mm) diameter outer conductor. The comparatively slender bore through the wellhead allows a greater thickness for the wellhead than is usual. However, the invention is not necessarily limited to the stated dimensions of the riser system or other components.

The major components of the assembly are a generally cylindrical wellhead body 1 and a generally cylindrical conductor housing 2 within which the body 1 is received. The conductor housing 2 has a lower annular weld preparation profile 3 and, by means of a weld 4, supports an outer cylindrical conductor casing 5 that extends downwardly from the conductor housing 2 into a (pre-drilled) hole in the seabed (not shown).

The lower part 6 of the body 1 tapers inwardly to a slim weld preparation profile 7 which abuts and, by means of a weld 8, supports a casing extension 9. In this example the casing extension 9 has an outside diameter of 14" (355.6 mm) and an inside diameter of 13 ⅝" (346 mm).

Typically the casing extension 9 extends down at least as far as the level of the seabed and preferably somewhat further. The conductor casing 2 has lateral vent ports 10 in communication with the annular space 11 between the outer conductor 5 and the casing extension 9.

A column of cement is formed in the space 11 between the outer conductor 5 and the casing extension 9 (and any casing components suspended from it). Cement is pumped down the well and rises up the annular space 11 up to at least the lower part 6 of the body 1 and possibly as far as the ports 10.

Wellhead systems are exposed to cyclic forces which will, if great enough, lead to potential fatigue damage and integrity failure of all or part of the wellhead system. Cement on the outside of the wellhead extension will reduce the freedom for the extension to flex and so the repetitive stresses may be high enough for potential fatigue failure.

In this example the casing extension 9 is provided with a segmented resilient sleeve 12 made of rubber or other suitable polymeric material. The sleeve extends all the way round the extension and extends from just above weld 8 between the profile 7 at the lower end 6 of the wellhead body 1 for a suitable distance part of, or all, the way down the casing extension 9. The thickness of the sleeve 12 needs to be selected such that it allows some flexure of the casing extension and allows sufficient circulation flow-by but does not prejudice the structural support that the extension requires. Such flexure will reduce the stresses occurring in the weld 8 between the profile 7 and the extension 9 and in the extension 9 itself.

The sleeve 12 is, in accordance with an exemplary embodiment of the invention, composed of a multiplicity of annular segments embodied by the inter-fitting rings 13*a*, 13*b*. These rings, except for the uppermost ring 13*a*, each have an upper outer flange 14 and an inner lower flange 15 so that each upper flange 14 fits over a shoulder formed by the lower flange 15 on the adjacent upper ring. Each of the upper flanges 14 has a radial through-bore 16 which facilitates the close fitting of the rings 13, acting as a vent for any fluid trapped when the rings are fitted together. The rings thereby fit snugly together to form a substantially continuous resilient sleeve on the outside of the casing extension 9. The segmented sleeve 12 may therefore be provided to any desired depth on the casing extension. The uppermost ring 13*a* overlaps the profile 7 and is shaped on its inside to conform to the profile 7. The inner flanges 15 may be bonded to the extension 9.

The thickness of the sleeve may be in the range of 15-35 mm. In the example, the sleeve 12 has an outside diameter of 18" (457 mm) and an inner diameter of 14" (356 mm).

The conductor housing 2 is pre-tensioned by means of a tensioning device 17 in which, as described in GB patent No. 2393990 and U.S. Pat. No. 7,025,145, movement of an operating member 18 causes outward oblique movement of a driving ring 19 and thereby tensioning of the housing 2.

Within the casing extension 9 is disposed a production casing 20 extending downwardly from and supported by a casing hanger 21. In this example the production casing has a 10.75" (273.05 mm) outside diameter.

The annular space 22 defined at its inner periphery by the production casing and at its outer periphery by the casing extension 9 (and the casing string depending therefrom) is usually called the 'B' annulus. Normally the B annulus is sealed by cement at its lower end and sealed by means of a 'pack-off' at the production casing hanger. Monitoring of the pressure within the B annulus enables the detection of for example a leak in a casing string. Such a leak is liable to cause collapse or other damage to the production casing. The described wellhead provides a system in which an access to the B-annulus may be controlled by way of a production tree, avoiding penetration of or valves in the casing hanger and other complexities.

Extending obliquely upwardly from the inner surface of the lower part 6 of the wellhead body 1 are passages 23 in communication with an annular gallery 24. Extending upwardly within the body 1 from the gallery 24 is a vertical passageway 25 (shown by a chain line in FIG. 1) which leads to an annular gallery 26 on the outside of a slide valve 27 disposed about a sleeve 28 that fits into the upper part of the bore 29 which extends axially through the wellhead body 1. The sleeve defines with the wall of the bore 29 a chamber for the valve 27. The valve 27 is biased to a closed (lower) position by means of one or more springs 30 between the top shoulder of the valve and a radial flange 31 of the sleeve 28.

The valve 27 can be moved between its open (upper) position and closed (lower) position by the application of fluid pressure either above or below the valve by way of passages not shown in FIG. 1. When the valve 27 is in its open position the vertical passageway 25 from the B annulus is in communication by way of the gallery 26 in the valve 27 with an isolation sleeve (not shown in FIG. 1) disposed above the sleeve 28. The valve 27 and the sleeve 28 have lateral seals adjacent the inner wall of the bore 29.

The passageway 25 is a bore which extends from a shoulder 37 around the top aperture of the wellhead vertically through the body 1 to the gallery 24 which is in communication with the region of the B annulus 22. The passageway 25 can extend along and within the wall of the body in this manner owing to the comparative thickness of the wall and the comparatively slender bore of the wellhead. The passage 25 is blocked at its top 38 after it has been formed.

The production casing hanger 21 carries a split ring 32 which is forced laterally into a recess in the bore when the production casing hanger is landed. The recess has oblique load bearing surfaces so that load can be transferred from the hanger 21 to the body 1.

The casing hanger 21 has an upper pack-off 34 which is forced into a profile in the bore by an activating sleeve 36. Within the sleeve 36 is a resilient barrel-shaped ring (collet) 35 which, in a manner not relevant to the present invention, aids the release of the pack-off from a running tool (not shown) and maintains the pack-off in position after it has been set in place.

Also shown in FIG. 1 is a slot 37 which allows by-pass of a tubing hanger (not shown) into the body 1 of the wellhead. This feature is not relevant to the claimed invention and will not be described further.

The invention claimed is:

1. A subsea wellhead comprising:

a generally cylindrical wellhead body including an extension forming an annular space for a cement column between the extension and an outer conductor of the subsea wellhead, said extension carrying a multiplicity of interfitting rings, said interfitting rings forming a substantially continuous resilient sleeve which facilitates flexure of the extension in the presence of a cement column when installed.

2. The subsea wellhead of claim 1 wherein:

each ring comprises an inner flange for disposition adjacent the outside of said extension and an outer flange for fitment over the inner flange of an adjacent ring.

3. The subsea wellhead of claim 2 wherein:

the outer flange has a radial through-bore.

4. The subsea wellhead of claim 1 wherein:

the thickness of the resilient sleeve is between 15 and 35 mm.

5. The subsea wellhead of claim 1 wherein:

there is a weld joining the extension to a lower part of the body and the sleeve extends over the weld.

6. The subsea wellhead of claim 1 wherein:

the rings are made of polymeric material.

7. A subsea wellhead comprising:

a generally cylindrical body including an extension for forming an annular space for a cement column between the extension and an outer conductor, wherein:

said extension carries a multiplicity of interfitting rings of polymeric material forming a resilient sleeve which facilitates flexure of the extension in the presence of the cement column;

each ring comprises an inner flange for disposition adjacent an outside of said extension and an outer flange for fitment over the inner flange of an adjacent ring; the thickness of said resilient sleeve is between 15 and 35 mm; and there is a weld joining the extension to said body and said resilient sleeve extends over the weld.

* * * * *